United States Patent [19]

Mezin et al.

[11] Patent Number: 5,001,892

[45] Date of Patent: Mar. 26, 1991

[54] EQUINE EQUIPMENT

[75] Inventors: Robert R. Mezin, Escondido, Calif.; Thomas R. Chown, Pilot Point, Tex.

[73] Assignee: Kathy's Show Equipment, Escondido, Calif.

[21] Appl. No.: 473,860

[22] Filed: Feb. 2, 1990

[51] Int. Cl.[5] ..... B68B 1/00

[52] U.S. Cl. ..... 54/71

[58] Field of Search ..... 54/6 A, 6 R, 24, 71

[56] References Cited

U.S. PATENT DOCUMENTS

| | | | |
|---|---|---|---|
| 969,203 | 9/1910 | Sell | 54/71 |
| 1,552,145 | 9/1925 | Haile | 54/71 |
| 2,457,246 | 12/1948 | Lawrence | 54/24 |
| 2,572,517 | 10/1951 | Ratliff | 54/6 R |
| 2,625,780 | 1/1953 | Flatt | 54/6 R |
| 3,149,448 | 9/1964 | Smith . | |
| 3,273,311 | 9/1966 | Henry | 54/24 |
| 3,306,005 | 2/1967 | Stafford | 54/6 |
| 3,458,971 | 8/1969 | Stern et al. | 54/6 |
| 4,459,795 | 7/1984 | Le Tixerant | 54/24 X |
| 4,583,493 | 4/1986 | Terry | 54/71 X |
| 4,621,591 | 11/1986 | Anderson et al. | 54/24 X |

FOREIGN PATENT DOCUMENTS

| | | | |
|---|---|---|---|
| 473780 | 8/1975 | Australia | 54/72 |
| 494836 | 11/1938 | United Kingdom | 54/24 |

*Primary Examiner*—John G. Weiss
*Assistant Examiner*—R. Thomas Price
*Attorney, Agent, or Firm*—Baker, Maxham, Jester & Meador

[57] ABSTRACT

An equine control device includes an integral loop extending from a central lower base member at a predetermined angle. Rein retention areas are provided on either side of the base member and the predetermined angle is maintained in order to insure that the rein retention areas remain spatially separated and the loop retains a generally rounded shape. Upper retention areas for additional bridle components, and an upper padded area may further be provided. The device may be formed from braided rawhide so as to be particularly suited for equine show arenas.

14 Claims, 3 Drawing Sheets

EQUINE EQUIPMENT

BACKGROUND OF THE INVENTION

The field of the present invention is equine equipment, and in particular, equipment to control and direct equine movement, as for example, bridles, halters and the like.

Apparatus for controlling and directing equine movement are well known. Bridles have been proposed wherein a bit inserted in the animal's mouth is used to control and direct movement through a pair of reins attached to the bit. The hackamore bridle dispenses with the mouth bit and instead employs a nose loop which directs and controls equine movement by applying pressure to nerves in the animal's muzzle. The traditional Spanish bosal is used extensively in connection with show horses and is effective in positioning the animal's head and neck in a show stance. A traditional Spanish bosal is illustrated in FIGS. 1 and 2. Typically, the bosal comprises a teardrop-shaped weighted leather loop having a braided knot at the bottom. A leather ring surrounds both stems of the loop as they enter the knot and can be slid to make the loop somewhat smaller. The traditional bosal is used with decorative reins made from braided horse hair. The horse hair reins are knotted around the stems of the loop, above the bottom knot. The size of the loop is controlled by winding the horse hair reins around the two stems, normally above the leather ring.

The prior art bosal is a relatively heavy structure and thus may adversely affect control and comfort, particularly in younger horses. Heavy weight, and the bosal's tendency to swing and bounce as a result of the long stem and repeated winding of the reins thereon, may cause the animal's head to bob up and down, which may be penalized under equine show rules. Moreover, the swinging bosal may be interpreted by the horse as a correction signal, and the horse may thus become desensitized to genuine correction efforts. Because of the difference in shape of the nose of younger or smaller horses, the traditional teardrop shape bosal also tends to be uncomfortable and ill fitting when used on them. Moreover, braided horse hair reins tend to abrade the neck and shoulders of the horse as a result of continuous sliding contact therewith, and are particularly uncomfortable and chafing on the more tender hide of younger horses. Horse hair reins, which are typically made from course tail hair, are also uncomfortable for many riders who do not wear protective gloves.

SUMMARY OF THE INVENTION

The present invention is directed to a bitless equine control device particularly adapted for show horses which is of light weight, provides superior fit, provides for the use of leather reins rather than braided horse hair, and which is aesthetically pleasing. In accordance with one aspect of the invention, there may be provided an integral rounded loop extending from a central lower base member. Means adjacent the base member may be provided for the attachment of leather reins, which areas can be maintained in spaced relation so as to prevent binding of the reins and maintenance of a generally rounded loop shape. In another aspect, means may be provided to retain the reins in position adjacent the base member so as to further increase control over the animal. In a still further aspect, additional means may be provided for attaching other bridle components and for padding the region where the device rests on the animal's muzzle.

BRIEF DESCRIPTION OF THE DRAWING

The objects, advantages and features of this invention will be more readily appreciated when read in conjunction with the accompanying drawing, in which.

DETAILED DESCRIPTION OF THE PREFERRED EMBODIMENTS

Figure 1:
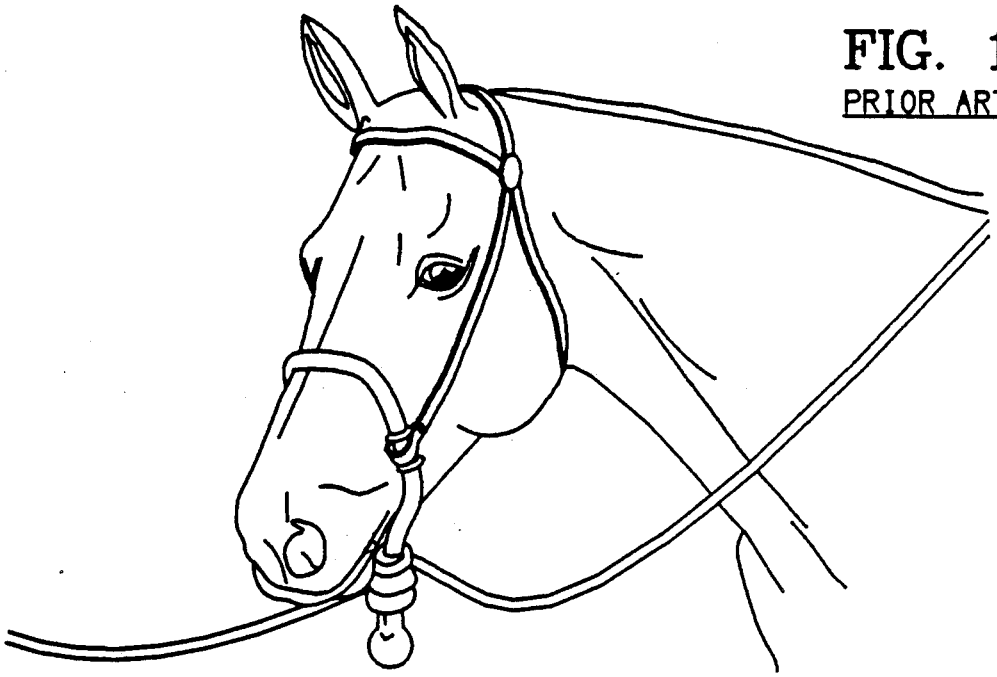
FIG. 1 PRIOR ART
FIG. 1 illustrates a prior art bridle comprising a traditional Spanish bosal of generally teardrop shape, and providing for the attachment of horse hair reins around the stem of the loop, below the horse's muzzle.
Figure 2:
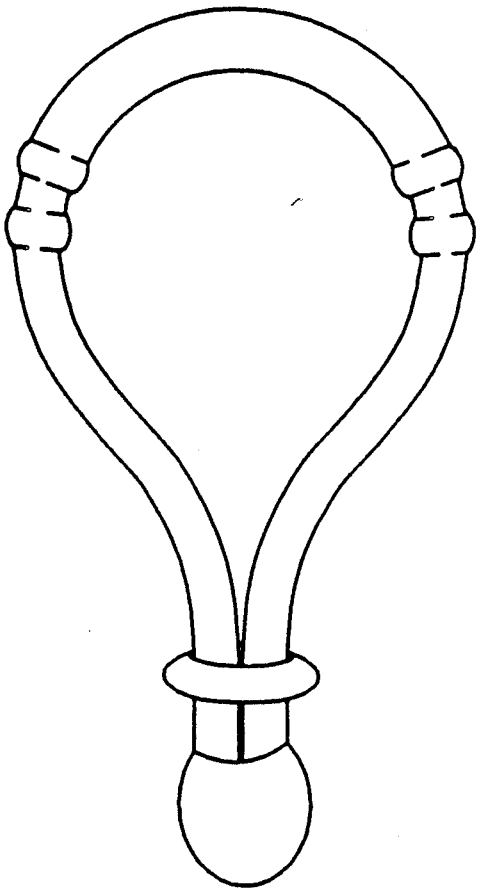
FIG. 2 PRIOR ART
FIG. 2 is a plan view of the prior art bosal illustrated in FIG. 1 showing the general teardrop shape provided by the elongated stem area.
Figure 3:
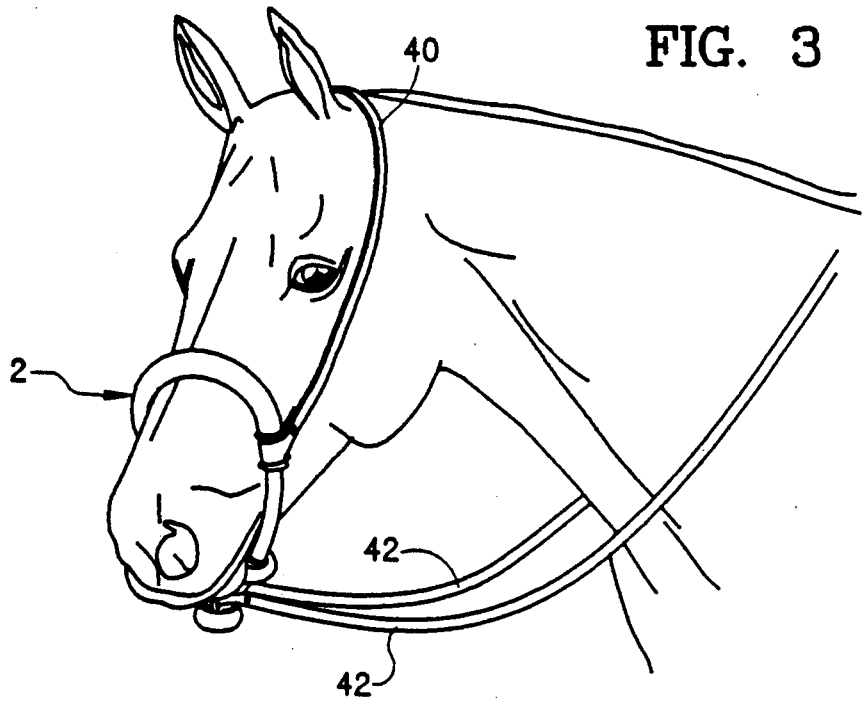
FIG. 3 is an illustration of an equine control device constructed in accordance with the present invention as it would be placed on an animal.
Figure 4:
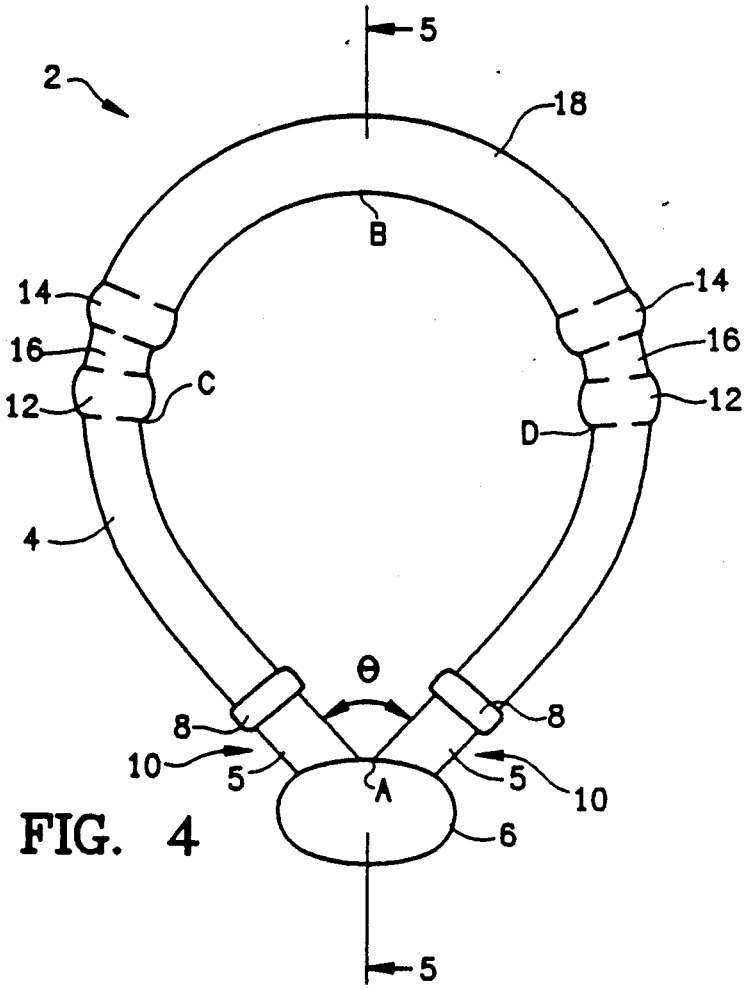
FIG. 4 is a plan view of the equine control device illustrated in FIG. 3.
Figure 5:
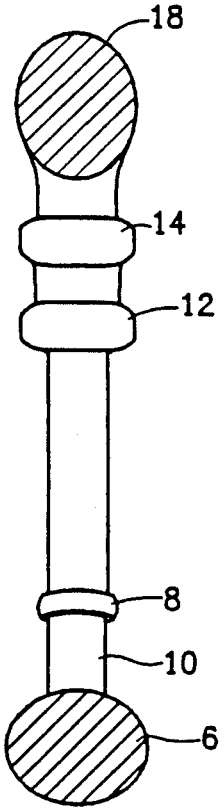
FIG. 5 is a cross-sectional view taken through line 5—5 in FIG. 4.
Figure 6A:
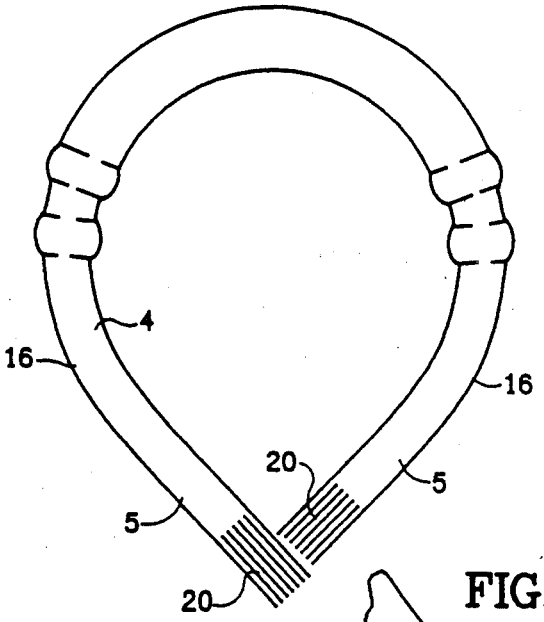
FIGS. 6*a–h* represent a series of diagrammatic views showing the construction of the loop and base portion of the equine control device illustrated in FIGS. 3–5.
Figure 6B:
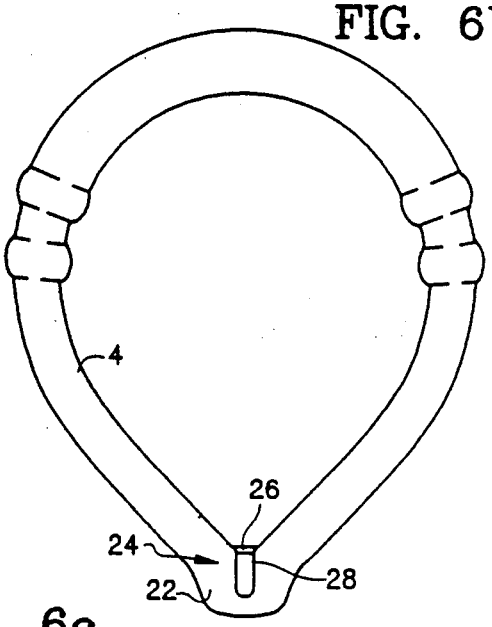
Figure 6C:
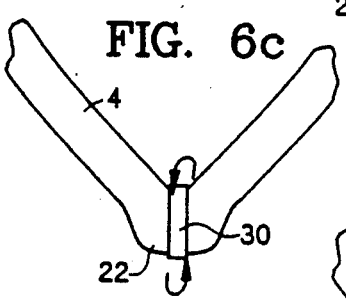
Figure 6D:
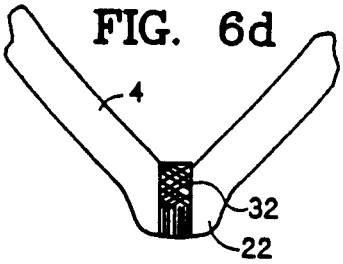
Figure 6E:
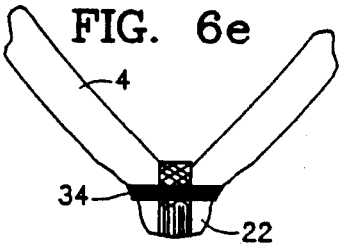
Figure 6F:
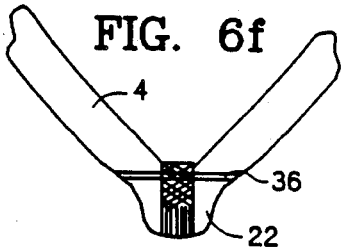
Figure 6G:
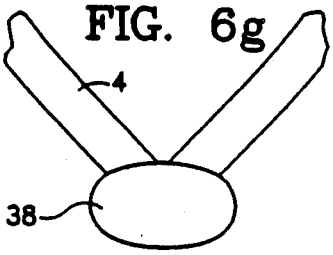
Figure 6H:
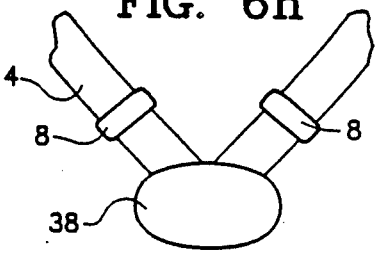

Referring now to FIGS. 3–5, an equine control device 2 comprises an integral loop 4 extending from a base member 6. The loop 4 is generally rounded in shape so as to fit comfortably around a horse's muzzle and is sized so as to fit sufficiently low on the animal's muzzle to achieve optimal control and posture. Thus, the maximum height of the loop 4 (shown in FIG. 4 as extending between points A and B) may be in a range of about 8 to 10 inches, as for example, about 9 inches. The maximum width of the loop 4 (shown in FIG. 4 as extending between points C and D) may be in a range of about 5½ to 6½ inches, as for example, about 6 inches. The aspect ratio of the loop 4 (the distance between points A and B divided by the distance between points C and D) may be in the range of about 1.45 to 1.55, as for example, about 1.5. Thus, a generally rounded loop shape may be facilitated.

As shown in FIG. 6, the loop 4 may be formed from braiding a plurality of rawhide strands in accordance with conventional braiding techniques. In the present embodiment, sixteen rawhide strands were used, although many other braiding configurations could be employed. Other materials, natural or synthetic, could also be used to form a braided loop. Still further, the loop could be molded plastic or formed from other non-braided materials.

The loop 4 comprises a pair of stem elements 5 extending from the base 6 at a predetermined angle theta whereby the stem elements are maintained in spaced relation as they extend from the base. This angle may be selected to provide a generally rounded loop shape providing optimum control while maintaining an appropriate degree of animal comfort. In the present embodiment this angle is approximately ninety degrees (90°). Other angles could also be employed, as for example, between about 50 and 90 degrees. Mounted laterally of the base member 6 on the loop stem elements 5 are a pair of ring members 8 which may also be formed from braided rawhide. The lateral ring members 8 define a pair of rein retention areas 10 on the loop 4 extending between the ring members 8 and the base member 6, to retain a pair of reins in spaced relation on the loop 4 in proximal relation with the base member 6.

The rein retention areas 10 are ideally suited for the attachment of leather reins. To that end, the angle theta is maintained relatively constant by means of a spacer member disposed in the base member 6, (shown in FIG. 6 and described hereinafter), so that the loop 4 will remain generally rounded in shape and the reins will be freely rotatable. Alternatively, the loop 4 and base member 6 may be formed of rigid material whereby the angle theta is maintained by the rigidity of the components themselves.

Disposed toward the top of the loop 4 are two pairs of ring members, 12 and 14, which may be formed from braided rawhide and which define upper retaining areas 16 for the attachment of additional bridle components. Disposed between the upper ring members 14 is a braided padded area 18 of enlarged diameter which serves to pad the loop 4 in the area where it is supported on the horse's muzzle, thus providing additional comfort.

Turning to FIG. 6, the construction of a sixteen-stranded rawhide control device is shown. As illustrated in FIGS. 6*a* and *b*, the sixteen strands 20 extending from each stem element 5 of the braided loop 4 are first braided together into a knot 22. As shown in FIG. 6*b*, a generally T-shaped spacer 24 is formed from folded rawhide rectangles 26 and 28. The upper rectangle 26 may be ⅜ inch wide X 1 inch long and the lower rawhide rectangle 28 may be ½ inch wide X 1 inch long. The spacer 24 is placed into the knot 22. As illustrated in FIG. 6*c*, a flat rawhide strip 30 may be laced around the spacer 24 and the knot 22 to secure the spacer within the knot. The rawhide strip 30 may be ⅝ to ¾ inches wide and is wrapped in a generally vertical orientation. Turning to FIG. 6*d*, the flat rawhide strip 30 is overlayed with a seven stranded braided overlay 32 whose ends are wrapped around the bottom of the knot 22, but which remain loose. As shown in FIGS. 6*e* and *f*, the seven stranded overlay 32 may be secured using a copper wire 34 wrapped in a generally horizontal orientation around the knot 22. Alternatively, a pair of "U" nails 36 may be wrapped around the knot. Thereafter, as shown in FIG. 6*g*, a cover 38 for the base 6 is braided over the knot 22 to complete construction of the base. As illustrated in FIG. 6*h*, the braided rings 8 may then be added to the loop 4 as may the upper ring members 12 and 14 and the padded area 18.

In operation, the control device 2 may be secured to a horse as shown in FIG. 3, with a single strap member 40 extending from strap retaining areas 16 around the back of the horses head, and a pair of leather reins 42 extending from the lower rein retention areas 10. The control device 2 will be more comfortable for younger horses because of its generally rounded shape and because its size is not adjusted by pinching the lower portion of the loop using a ring or reins slideably retained on a loop stem, as in the prior art bosal. Moreover, the use of irritating horse hair reins can be avoided.

Thus, a novel equine control device having the advantages of light weight, better fit, and increased equine control has been disclosed. While applications and embodiments of this invention have been shown and described, it would be apparent to those skilled in the art that many more modifications are possible without departing from the inventive concepts herein. The invention, therefore is not to be restricted except in the spirit of the appended claims.

What is claimed is:

1. An equine control device comprising an integral loop comprising a pair of loop elements extending from a central lower base, said loop elements comprising a pair of rein retention areas proximate to said base, said loop elements extending from said base at an angle sufficient to spatially separate said rein retention areas from each other, wherein said loop is braided and said base is formed by braiding together said loop elements to form a knot, securing a generally T-shaped spacer in said knot and braiding a cover over said knot and said spacer.

2. An equine control device comprising a length of braided material whose ends are braided together as a junction to form a rounded loop, a central lower base formed by a generally T-shaped spacer disposed at the junction of said braided loop ends, said loop ends being secured to said spacer by a rawhide strip wrapped in a generally vertical orientation, by an additional braided overlay, and by a wire wrapping extending in a generally horizontal orientation, said base being completed by forming a braided cover over said junction, said control device further comprising a pair of rein retention areas formed on either side of said base by a pair of braided rings mounted on said loop, and a pair of upper retentions areas formed by two pairs of braided rings mounted on said loop, said control device further comprising an upper padded area comprising a braided section disposed between said upper rings.

3. An equine control device comprising an integral loop, said loop including a pair of loop stem elements joined in contiguous relation to form a loop junction at the bottom of said loop, said loop stem elements each comprising a rein retention area fixedly positioned proximate to said junction, and said device further including spacing means for maintaining an angle between said loop stem elements as they converge at said junction sufficient to spatially separate said rein retention areas from each other.

4. The equine control device set forth in claim 3 wherein said angle is in a range of about 50 to 90 degrees.

5. The equine control device set forth in claim 3 wherein said angle between said loop stem elements is maintained by a spacer wedged between said loop stem elements at said junction.

6. The equine control device set forth in claim 3 wherein said rein retention areas extend between said junction and a pair of ring elements disposed on said loop stem elements.

7. The equine control device set forth in claim 3 further including a pair of upper retention areas for retaining additional bridle components.

8. The equine control device set forth in claim 3 wherein said loop is braided.

9. The equine control device set forth in claim 3 wherein said loop is braided and said loop stem elements are braided together at said junction.

10. The equine control device set forth in claim 3 wherein said loop is braided, said loop stem elements are braided together at said junction and wherein a cover is braided around the braided ends of said loop stem elements.

11. The equine control device set forth in claim 3 wherein said loop is braided and said junction is formed by braiding together said loop stem elements to form a knot, securing a spacer between said loop stem elements and braiding a cover over said knot and said spacer.

12. An equine control device comprising a length of braided material whose ends are braided together at a junction of the ends of said length of braided material to form a generally rounded loop, said junction being formed by braiding together said ends, a central lower base comprising spacing means between said ends at said junction for keeping said ends apart as they extend from said junction, said spacing means being secured to said junction by a rawhide strip wrapped in a generally vertical orientation, by an additional braided overlay, and by a wire wrapping extending in a generally horizontal orientation, said base being completed by forming a braided cover over said loop junction, said control device further comprising a pair of rein retention areas formed on either side of said base by a pair of braided rings mounted on said loop, and a pair of upper retentions areas formed by two pairs of braided rings mounted on said loop, said control device further comprising an upper padded area comprising a braided section disposed between said upper rings.

13. An equine control device comprising a braided loop, said loop including a pair of loop elements extending from a central lower base, each said loop element comprising a rein retention area fixedly positioned adjacent to said base, said loop elements extending from said base at an angle sufficient to spatially and substantially separate said rein retention areas.

14. The equine control device set forth in claim 13 wherein said base is formed by braiding together said loop elements to form a knot, securing a spacer in said knot and braiding a cover over said knot and said spacer.

* * * * *